US012185753B2

(12) United States Patent
Tronza et al.

(10) Patent No.: US 12,185,753 B2
(45) Date of Patent: Jan. 7, 2025

(54) AEROSOL GENERATING DEVICE WITH HINGED LID AND MOUTHPIECE

(71) Applicant: Philip Morris Products S.A., Neuchatel (CH)

(72) Inventors: Mario Tronza, Biel/Bienne (CH); Mario Weiss, Biel/Bienne (CH); Jun Wei Yim, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 18/559,175

(22) PCT Filed: May 9, 2022

(86) PCT No.: PCT/EP2022/062431
§ 371 (c)(1),
(2) Date: Nov. 6, 2023

(87) PCT Pub. No.: WO2022/238297
PCT Pub. Date: Nov. 17, 2022

(65) Prior Publication Data

US 2024/0225092 A1 Jul. 11, 2024

(30) Foreign Application Priority Data

May 12, 2021 (EP) ..... 21173637

(51) Int. Cl.
*A24F 40/20* (2020.01)
*A24F 15/18* (2006.01)
*A24F 40/46* (2020.01)

(52) U.S. Cl.
CPC ..... *A24F 15/18* (2013.01); *A24F 40/20* (2020.01); *A24F 40/46* (2020.01)

(58) Field of Classification Search
CPC ..... A24F 40/20; A24F 40/46; A24F 15/18
See application file for complete search history.

(56) References Cited

U.S. PATENT DOCUMENTS 9,271,526 B2 * 3/2016 Liu ..... A24F 15/01
10,136,677 B2 * 11/2018 Qiu ..... H05B 1/02
(Continued)

FOREIGN PATENT DOCUMENTS

CN 109641117 A 4/2019
RU 2 157 251 C1 10/2000
RU 2 606 655 C2 1/2017
WO WO 2007/022573 A1 3/2007
(Continued)

OTHER PUBLICATIONS

Office Action dated Jan. 18, 2024, issued in corresponding Chinese patent application No. 202280029153.1 (with English translation).
(Continued)

*Primary Examiner* — Abdullah A Riyami
*Assistant Examiner* — Thang H Nguyen
(74) *Attorney, Agent, or Firm* — Oblon, McClelland, Maier & Neustadt, L.L.P.

(57) ABSTRACT

An aerosol-generating device is provided, including: a housing having a main portion and a lid portion, the lid portion being hingedly connected to the main portion; a mouthpiece disposed on the lid portion, the mouthpiece being configured to be moveable between a first position, in which the mouthpiece is retracted into the housing, and a second position, in which the mouthpiece protrudes from the lid portion; and a spring-loaded mechanism configured to move the mouthpiece from the first position into the second position.

14 Claims, 5 Drawing Sheets

(56) References Cited

U.S. PATENT DOCUMENTS

| | | | | |
|---|---|---|---|---|
| 11,744,286 | B2 * | 9/2023 | Qin | A24F 40/40 131/328 |
| 2007/0045288 | A1 * | 3/2007 | Nelson | A61M 11/041 219/533 |
| 2008/0251551 | A1 * | 10/2008 | Huber | A61M 15/009 128/200.23 |
| 2010/0083963 | A1 * | 4/2010 | Wharton | A61M 15/009 128/203.15 |
| 2013/0167854 | A1 * | 7/2013 | Shin | A24F 40/42 131/329 |
| 2016/0213061 | A1 * | 7/2016 | Liu | H01M 50/213 |
| 2016/0295919 | A1 * | 10/2016 | Thomas, Jr. | A61M 11/042 |
| 2018/0027885 | A1 * | 2/2018 | Qiu | A61M 15/06 |
| 2021/0093007 | A1 * | 4/2021 | Fringeli | A24F 40/46 |
| 2021/0244896 | A1 * | 8/2021 | Mistry | A61K 9/008 |
| 2022/0039465 | A1 * | 2/2022 | Du | A24F 40/30 |
| 2022/0408808 | A1 * | 12/2022 | Shen | A24F 40/42 |

FOREIGN PATENT DOCUMENTS

| | | | | |
|---|---|---|---|---|
| WO | WO 2019/237151 | A1 | 12/2019 | |
| WO | WO-2020142826 | A1 * | 7/2020 | A24F 40/40 |
| WO | WO 2020/221674 | A1 | 11/2020 | |

OTHER PUBLICATIONS

International Search Report & Written Opinion mailed on Sep. 7, 2022 in PCT/EP2022/062431 filed on May 9, 2022 (12 pages).

International Preliminary Report on Patentability issued May 26, 2023 in PCT/EP2022/062431 filed on May 9, 2022, 12 pages.

Russian Search Report issued May 6, 2024 in Russian Patent Application No. 2023132556/03 (with English Translation of Category of Cited Documents), 3 pages.

Japanese Office Action issued Jun. 3, 2024 in Japanese Patent Application No. 2023-569933 (with unedited computer-generated English Translation), 8 pages.

* cited by examiner

AEROSOL GENERATING DEVICE WITH HINGED LID AND MOUTHPIECE

CROSS-REFERENCE TO RELATED APPLICATIONS

This application is a U.S. national stage application of PCT/EP2022/062431, filed on May 9, 2022, which is based upon and claims the benefit of priority under 35 U.S.C. § 119 from European patent application no. 21173637.6, filed May 12, 2021, the entire contents of each of which are incorporated herein by reference.

TECHNICAL FIELD

The present invention relates to an aerosol-generating device comprising a main portion and a hinged lid with a mouthpiece that is moveable between a first, retracted position and a second protruding position.

DESCRIPTION OF THE RELATED ART

Aerosol-generating devices that are configured to receive aerosol-generating articles that are heated to generate an inhalable aerosol are well known in the art. Such aerosol-generating devices may comprise a housing and a removable lid. In use the aerosol-generating article may be completely received in a closed cavity within the aerosol-generating device. A user may inhale the aerosol via the replaceable mouthpiece. In order to replace a used aerosol-generating article the lid and the mouthpiece may have to be removed and the aerosol-generating article has to be dislodged from the cavity of the aerosol-generating device. Thereafter a new aerosol-generating article may be inserted and the lid and the mouthpiece may be re-attached to the aerosol-generating device. After that the aerosol-generating device is ready to be used again.

Thus, a plurality of steps is required during extended use of the aerosol-generating device. The number of steps may be perceived to be too cumbersome by the average user.

Accordingly, it would be desirable to provide an aerosol-generating device that is easy to handle, in particular that facilitates replacement of the aerosol-generating articles.

It would be further desirable to provide an aerosol-generating device that allows to reliably and conveniently change used aerosol-generating articles.

It would be further desirable to provide an aerosol-generating device that allows for extended use of the device, in particular that allows for a plurality of consecutive user experiences.

SUMMARY

According to an embodiment of the present invention there is provided an aerosol-generating device comprising a housing having a main portion and a lid portion. The lid portion is hingedly connected to the main portion. The aerosol-generating device further comprises a mouthpiece which is provided at the lid portion. The mouthpiece is configured to be moveable between a first position, in which the mouthpiece is retracted into the housing, and a second position, in which the mouthpiece protrudes from the lid portion of the housing. The aerosol-generating device comprises a spring loaded mechanism, which is configured to move the mouthpiece between the first and second position.

BRIEF DESCRIPTION OF THE DRAWINGS

The invention will be further described, by way of example only, with reference to the accompanying drawings in which.

DETAILED DESCRIPTION

Figure 1:
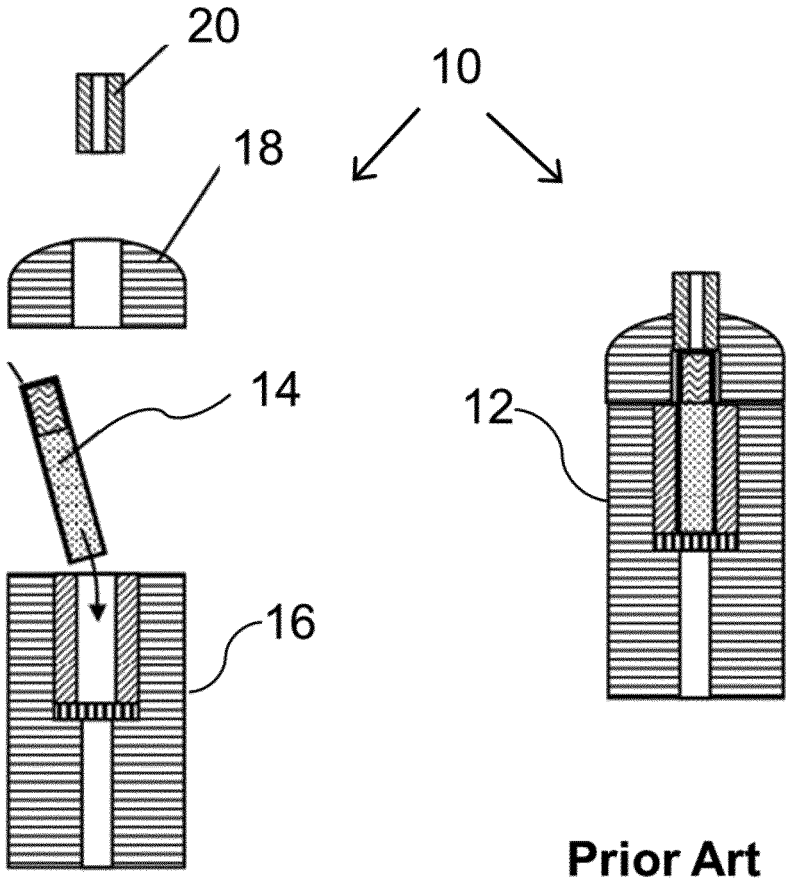
FIG. 1 shows a prior art aerosol-generating system.

As used herein, an 'aerosol-generating device' relates to a device that interacts with an aerosol-forming substrate to generate an aerosol. The aerosol-forming substrate may be part of an aerosol-generating article. For example, the aerosol-forming substrate may be part of an aerosol-generating article. The generated aerosol may be an aerosol that is directly inhalable into a user's lungs through the user's mouth. An aerosol-generating device may be a holder. The aerosol-generating device may be an electrically heated aerosol-generating device. The aerosol-generating device may comprise electric circuitry. The aerosol-generating device may comprise a power supply. The aerosol-generating device may comprise the heating chamber. The aerosol-generating device may comprise a heating element. The electric circuitry, the power supply, the heating chamber and the heating element are preferably arranged in the main body of the aerosol-generating device.

As used herein, the term 'aerosol-generating article' refers to an article comprising an aerosol-forming substrate that is capable of releasing volatile compounds that can form an aerosol. For example, an aerosol-generating article may be an aerosol-generating article that generates an aerosol that is directly inhalable into a user's lungs through the user's mouth. An aerosol-generating article may be disposable. An aerosol-generating article comprising an aerosol-forming substrate comprising tobacco may be referred to as a tobacco stick.

The aerosol-generating article may be substantially cylindrical in shape. The aerosol-generating article may be substantially elongate. The aerosol-generating article may have a length and a circumference substantially perpendicular to the length. The aerosol-forming substrate may be substantially cylindrical in shape. The aerosol-forming substrate may be substantially elongate. The aerosol-forming substrate may also have a length and a circumference substantially perpendicular to the length.

The aerosol-generating article may have a total length between approximately 30 mm and approximately 100 mm. The aerosol-generating article may have an external diameter between approximately 5 mm and approximately 12 mm. The aerosol-generating article may comprise a filter plug. The filter plug may be located at a downstream end of the aerosol-generating article. The filter plug may be a cellulose acetate filter plug. The filter plug is approximately 7 mm in length in one aspect, but may have a length of between approximately 5 mm to approximately 10 mm.

In one aspect, the aerosol-generating article may have a total length of approximately 45 mm. The aerosol-generating article may have an external diameter of approximately 7.2 mm. Further, the aerosol-forming substrate may have a length of approximately 10 mm. Alternatively, the aerosol-forming substrate may have a length of approximately 12 mm. Further, the diameter of the aerosol-forming substrate may be between approximately 5 mm and approximately 12 mm. The aerosol-generating article may comprise an outer paper wrapper. Further, the aerosol-generating article may comprise a separation between the aerosol-forming substrate and the filter plug. The separation may be approximately 18 mm, but may be in the range of approximately 5 mm to approximately 25 mm.

The heating chamber of the aerosol-generating device may have an elongate shape. The heating chamber of the aerosol-generating device may have a cross-section that corresponds to the cross-section of the aerosol-generating article that is to be used with and inserted into the heating chamber of the aerosol-generating device.

As used herein, the term 'aerosol-forming substrate' relates to a substrate capable of releasing volatile compounds that can form an aerosol. Such volatile compounds may be released by heating the aerosol-forming substrate. An aerosol-forming substrate may conveniently be part of an aerosol-generating article.

The aerosol-forming substrate may be a solid aerosol-forming substrate. Alternatively, the aerosol-forming substrate may comprise both solid and liquid components. The aerosol-forming substrate may comprise a tobacco-containing material containing volatile tobacco flavour compounds which are released from the substrate upon heating. Alternatively, the aerosol-forming substrate may comprise a non-tobacco material. The aerosol-forming substrate may further comprise an aerosol former that facilitates the formation of a dense and stable aerosol. Examples of suitable aerosol formers are glycerine and propylene glycol.

If the aerosol-forming substrate is a solid aerosol-forming substrate, the solid aerosol-forming substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco, cast leaf tobacco and expanded tobacco. The solid aerosol-forming substrate may be in loose form, or may be provided in a suitable container or cartridge. Optionally, the solid aerosol-forming substrate may contain additional tobacco or non-tobacco volatile flavour compounds, to be released upon heating of the substrate. The solid aerosol-forming substrate may also contain capsules that, for example, include the additional tobacco or non-tobacco volatile flavour compounds and such capsules may melt during heating of the solid aerosol-forming substrate.

As used herein, homogenised tobacco refers to material formed by agglomerating particulate tobacco. Homogenised tobacco may be in the form of a sheet. Homogenised tobacco material may have an aerosol-former content of greater than 5% on a dry weight basis. Homogenised tobacco material may alternatively have an aerosol former content of between 5% and 30% by weight on a dry weight basis. Sheets of homogenised tobacco material may be formed by agglomerating particulate tobacco obtained by grinding or otherwise combining one or both of tobacco leaf lamina and tobacco leaf stems. Alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco; alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof.

Optionally, the solid aerosol-forming substrate may be provided on or embedded in a thermally stable carrier. The carrier may take the form of powder, granules, pellets, shreds, spaghettis, strips or sheets. Alternatively, the carrier may be a tubular carrier having a thin layer of the solid substrate deposited on its inner surface, or on its outer surface, or on both its inner and outer surfaces. Such a tubular carrier may be formed of, for example, a paper, or paper like material, a non-woven carbon fibre mat, a low mass open mesh metallic screen, or a perforated metallic foil or any other thermally stable polymer matrix.

In a particularly preferred aspect, the aerosol-forming substrate comprises a gathered crimped sheet of homogenised tobacco material. As used herein, the term 'crimped sheet' denotes a sheet having a plurality of substantially parallel ridges or corrugations. Preferably, when the aerosol-generating article has been assembled, the substantially parallel ridges or corrugations extend along or parallel to the longitudinal axis of the aerosol-generating article. This advantageously facilitates gathering of the crimped sheet of homogenised tobacco material to form the aerosol-forming substrate. However, it will be appreciated that crimped sheets of homogenised tobacco material for inclusion in the aerosol-generating article may alternatively or in addition have a plurality of substantially parallel ridges or corrugations that are disposed at an acute or obtuse angle to the longitudinal axis of the aerosol-generating article when the aerosol-generating article has been assembled. In certain aspects, the aerosol-forming substrate may comprise a gathered sheet of homogenised tobacco material that is substantially evenly textured over substantially its entire surface. For example, the aerosol-forming substrate may comprise a gathered crimped sheet of homogenised tobacco material comprising a plurality of substantially parallel ridges or corrugations that are substantially evenly spaced-apart across the width of the sheet.

The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

The aerosol-forming substrate is a substrate capable of releasing volatile compounds that can form an aerosol. The volatile compounds may be released by heating the aerosol-forming substrate. The aerosol-forming substrate may comprise plant-based material. The aerosol-forming substrate may comprise tobacco. The aerosol-forming substrate may comprise a tobacco-containing material containing volatile tobacco flavour compounds, which are released from the aerosol-forming substrate upon heating. The aerosol-forming substrate may alternatively comprise a non-tobacco-containing material. The aerosol-forming substrate may comprise homogenised plant-based material.

The aerosol-forming substrate may comprise at least one aerosol-former. An aerosol-former is any suitable known compound or mixture of compounds that, in use, facilitates formation of a dense and stable aerosol and that is substantially resistant to thermal degradation at the temperature of operation of the system. Suitable aerosol-formers are well known in the art and include, but are not limited to:

polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Aerosol formers may be polyhydric alcohols or mixtures thereof, such as triethylene glycol, 1,3-butanediol and glycerine. The aerosol-former may be propylene glycol. The aerosol former may comprise both glycerine and propylene glycol.

The aerosol-generating device may comprise electric circuitry. The electric circuitry may comprise a microprocessor, which may be a programmable microprocessor. The microprocessor may be part of a controller. The electric circuitry may comprise further electronic components. The electric circuitry may be configured to regulate a supply of power to the heating element. Power may be supplied to the heating element continuously following activation of the aerosol-generating device or may be supplied intermittently, such as on a puff-by-puff basis. The power may be supplied to the heating element in the form of pulses of electrical current. The electric circuitry may be configured to monitor the electrical resistance of the heating element, and preferably to control the supply of power to the heating element dependent on the electrical resistance of the heating element.

The aerosol-generating device may comprise a power supply, typically a battery, within a main body of the aerosol-generating device. In one aspect, the power supply is a Lithium-ion battery. Alternatively, the power supply may be a Nickel-metal hydride battery, a Nickel cadmium battery, or a Lithium based battery, for example a Lithium-Cobalt, a Lithium-Iron-Phosphate, Lithium Titanate or a Lithium-Polymer battery. As an alternative, the power supply may be another form of charge storage device such as a capacitor. The power supply may require recharging and may have a capacity that enables to store enough energy for one or more usage experiences; for example, the power supply may have sufficient capacity to continuously generate aerosol for a period of around six minutes or for a period of a multiple of six minutes. In another example, the power supply may have sufficient capacity to provide a predetermined number of puffs or discrete activations of the heating element.

In all of the aspects of the disclosure, the heating element may comprise an electrically resistive material. Suitable electrically resistive materials include but are not limited to: semiconductors such as doped ceramics, electrically "conductive" ceramics (such as, for example, molybdenum disilicide), carbon, graphite, metals, metal alloys, and composite materials made of a ceramic material and a metallic material. Such composite materials may comprise doped or undoped ceramics. Examples of suitable doped ceramics include doped silicon carbides. Examples of suitable metals include titanium, zirconium, tantalum platinum, gold, and silver. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese-, gold-, and iron-containing alloys, and super-alloys based on nickel, iron, cobalt, stainless steel, TIMETAL® and iron-manganese-aluminium based alloys. In composite materials, the electrically resistive material may optionally be embedded in, encapsulated, or coated with an insulating material or vice-versa, depending on the kinetics of energy transfer and the external physicochemical properties required.

The heating element may be part of the aerosol-generating device. The aerosol-generating device may comprise an external heating element.

The term "external" in this context means that the heating element is provided "external" with respect to the aerosol-forming substrate.

An external heating element may take any suitable form. For example, an external heating element may take the form of one or more flexible heating foils on a dielectric substrate, such as polyimide. The flexible heating foils can be shaped to conform to the perimeter of the substrate receiving cavity. Alternatively, an external heating element may take the form of a metallic grid or grids, a flexible printed circuit board, a molded interconnect device (MID), ceramic heater, flexible carbon fibre heater or may be formed using a coating technique, such as plasma vapour deposition, on a suitable shaped substrate. An external heating element may also be formed using a metal having a defined relationship between temperature and resistivity. In such an exemplary device, the metal may be formed as a track between two layers of suitable insulating materials. An external heating element formed in this manner may be used to both heat and monitor the temperature of the external heating element during operation.

As an alternative to an electrically resistive heating element, the heating element may be configured as an induction heating element. The induction heating element may comprise an induction coil and a susceptor. In general, a susceptor is a material that is capable of generating heat, when penetrated by an alternating magnetic field. When located in an alternating magnetic field. According to the invention, the susceptor may be electrically conductive or magnetic or both electrically conductive and magnetic. An alternating magnetic field generated by one or several induction coils heat the susceptor, which then transfers the heat to the aerosol-forming substrate, such that an aerosol is formed. The heat transfer may be mainly by conduction of heat. Such a transfer of heat is best, if the susceptor is in close thermal contact with the aerosol-forming substrate.

The susceptor may be formed from any material that can be inductively heated to a temperature sufficient to generate an aerosol from the aerosol-forming substrate. A preferred susceptor may comprise or consist of a ferromagnetic material or ferri-magnetic material, for example a ferromagnetic alloy, ferritic iron, or a ferromagnetic steel or stainless steel. A suitable susceptor may be, or comprise, aluminium. Preferred susceptors may be heated to a temperature in excess of 250 degrees Celsius.

Preferred susceptors are metal susceptors, for example stainless steel. However, susceptor materials may also comprise or be made of graphite, molybdenum, silicon carbide, aluminum, niobium, Inconel alloys (austenite nickel-chromium-based superalloys), metallized films, ceramics such as for example zirconia, transition metals such as for example iron, cobalt, nickel, or metalloids components such as for example boron, carbon, silicon, phosphorus, aluminium.

When an induction heating element is employed, the induction heating element may be configured as an external heater as described herein. If the induction heating element is configured as an external heating element, the susceptor element is preferably configured as a cylindrical susceptor at least partly surrounding the cavity or forming the sidewall of the cavity.

The heating element advantageously heats the aerosol-forming substrate by means of conduction. The heating element may be at least partially in contact with the substrate, or the carrier on which the substrate is deposited.

The hinged lid portion of the housing of the aerosol-generating device may be moveable between a closed and an open position. When the lid is in the open position, the heating chamber of the aerosol-generating device is accessible. When the lid is in the open position, an aerosol-generating article may be inserted or removed from the heating chamber of the aerosol-generating device.

When the lid portion is in the closed position, the heating chamber of the aerosol-generating device is not accessible by the user. When the lid portion is in the closed position, an aerosol-generating article may be retained by the lid portion in the heating chamber of the aerosol-generating device.

During operation, the hinged lid portion may be in a closed position. During operation, the aerosol-forming substrate may be completely contained within the aerosol-generating device. During operation, the aerosol-forming article may be completely contained within the aerosol-generating device. During operation, the aerosol-forming article may be received within the heating chamber of the aerosol-generating device. In that case, a user may puff on the mouthpiece of the aerosol-generating device.

The spring loaded mechanism may be configured to perform movement of the mouthpiece upon opening or closure of the lid portion. The spring loaded mechanism may be configured to perform movement of the mouthpiece in dependence of the presence or the absence of an aerosol-generating article in the heating chamber of the aerosol-generating device.

The spring loaded mechanism may be configured to move or retain the mouthpiece in a first, retracted position when the lid is in the open position or when no aerosol-generating article is inserted into the heating chamber.

By retracting the mouthpiece into the housing, the mouthpiece does not protrude from the housing anymore. This may facilitate handling of the aerosol-generating device. This may particularly facilitate storing the aerosol-generating device in a user's pocket or bag. In addition by retracting the mouthpiece into the housing, the mouthpiece may be protected from unintentional damage.

The mouthpiece may be configured to be linearly movable in a corresponding guide channel of the lid portion. The spring loaded mechanism may comprise a spring that biases the mouthpiece towards the housing or the lid portion when the lid portion is in the open position or when no aerosol-generating article is inserted into the heating chamber. The spring may be configured such that the mouthpiece is fully retracted into the lid portion in the first position.

The aerosol-generating device may be configured such that the spring loaded mechanism moves the mouthpiece in a second position when an aerosol-generating article is in the heating chamber of the aerosol-generating device. In the second position the mouthpiece may be configured to protrude from the lid of the aerosol-generating device.

The aerosol-generating device may be configured such that the spring loaded mechanism automatically moves the mouthpiece into the second, protruding position upon closure of the lid portion in case an aerosol-generating article is present in the heating chamber of the aerosol-generating device.

The aerosol-generating device may be configured such that upon closure of the lid portion, the distal end of the mouthpiece contacts the proximal end of the aerosol-generating article that is inserted in the heating chamber of the aerosol-generating device.

As used herein, the terms 'upstream', 'downstream', 'proximal', 'distal', 'front' and 'rear', are used to describe the relative positions of components, or portions of components, of the aerosol-generating device in relation to the direction in which a user draws on the aerosol-generating device during use thereof.

The compression spring may have a spring constant that is smaller than the compression factor of the aerosol-generating article. The compression spring may have a spring constant that is smaller than 20 N/m. The compression spring may have a spring constant that is smaller than 10 N/m.

Accordingly, upon continued closure movement of the lid portion, the proximal end of the aerosol-generating article pushes the mouthpiece out of the lid portion while compressing the compression spring of the spring mechanism. When the lid portion is in the fully closed position, the mouthpiece protrudes from the lid portion. In this configuration the mouthpiece protrudes sufficiently far from the surface of the lid portion, such that the user may put the mouthpiece into the mouth for inhalation purposes.

With the above described spring mechanism the mouthpiece is automatically pushed out of the housing without any need of additional manipulation by the user. In addition, a protruding mouthpiece indicates to the user, that an aerosol-generating article is inserted into the heating chamber and that the aerosol-generating device may be ready for use.

The mouthpiece may be further configured to sealingly engage with the aerosol-generating article. Thus, when the mouthpiece is moved into the second position a defined air flow path may be established from the aerosol-generating article through the mouthpiece. This effect is further enhanced by the spring loaded mechanism, which in the second position presses the mouthpiece firmly against the proximal end of the aerosol-generating article.

The heating chamber of the aerosol-generating device may have a bottom surface that restricts movement of the aerosol-generating article into the heating chamber.

The main portion of the aerosol-generating device may be further configured to define a storage chamber. The storage chamber may be located adjacent to the heating chamber. The storage chamber may be separated from the heating chamber by the bottom surface of the heating chamber.

The storage chamber may have a size that corresponds at least to the size of an aerosol-generating article. The storage chamber may be configured for storing at least one aerosol-generating article. The storage chamber may be configured for storing at least one consumed aerosol-generating article.

The aerosol-generating device may be configured to facilitate movement of aerosol-generating articles from the heating chamber into the storage chamber. The aerosol-generating device may be configured to facilitate movement of aerosol-generating articles from the storage chamber into heating chamber.

In order to allow movement of aerosol-generating articles from or into the storage chamber, the aerosol-generating device may comprise an opening mechanism. The opening mechanism may be configured to establish an opening in the bottom surface of the heating chamber.

The opening mechanism may establish a passageway for moving an aerosol-generating article between the heating chamber and the storage chamber. For example a consumed aerosol-generating article may, after use, be transferred into the storage chamber. As a further example a fresh aerosol-generating article may be moved from the storage chamber into the heating chamber.

The bottom surface may be defined by a moveable element that is biased into a normally closed position by a suitable mechanism such as a spring mechanism. The moveable element may co-operate with a button or a slider. When the user activates the button or slider, the moveable element may be moved into an open position in which a passageway is opened between the heating chamber and the storage chamber.

In order to move the aerosol-generating article from the heating chamber into the storage chamber, the user may first activate the button or slider, in order to open the passage in the bottom of the heating chamber. The user may then push the mouthpiece into the housing. In that case the distal end of the mouthpiece pushes against the aerosol-generating article. Since the bottom surface of the heating chamber is now open, the inward movement of the aerosol-generating article is not restricted anymore and the aerosol-generating article is moved downward into the storage chamber.

Locating the storage chamber adjacent and below (when considering the design as depicted in the Figures discussed below) the heating chamber may be advantageous since gravity may promote transfer of the aerosol-generating article into the storage chamber.

A transfer mechanism may be provided that may further assist in the transfer of the aerosol-generating article into the storage chamber.

The transfer mechanism may comprise a rotating wheel that frictionally engages an outer surface of the aerosol-generating article to transfer the aerosol-generating article from the heating chamber into the storage chamber. The transfer mechanism may comprise two oppositely arranged rotating wheels. The oppositely arranged rotating wheels may frictionally engage the aerosol-generating article between them. By rotating the oppositely arranged rotating wheels the aerosol-generating article may be moved downwardly from the heating chamber into the storage chamber.

The one or more rotating wheels may be manually operated. To this end, the one or more rotating wheels may be directly or indirectly accessible by the user from the outside of the housing of the aerosol-generating device. Using such transfer mechanism offers the advantage that the aerosol-generating article does not need to be touched with the hand by the user. This may be perceived as to increase comfort in handling the aerosol-generating device.

The rotating wheels of the transfer mechanism may also be motor driven. In such embodiments the one or more rotating wheels may be mechanically engaged by an electric motor that may be controlled by the controller of aerosol-generating device. An electrically driven transfer mechanism may further increase handling of the aerosol-generating device. In addition, in such embodiments there is no need for the one or more rotating wheels to be mechanically engaged from the outside, which may be advantageous in terms of stowing the device when not in use.

The transfer mechanism may be triggered by a user operated switch or a push button provided at the housing of the aerosol-generating device. The transfer mechanism may also be automatically triggered by the user mechanism is triggered by the user pressing the mouthpiece towards the housing.

The mouthpiece may be made from rigid material. The mouthpiece may be made from polymeric material. The mouthpiece may have a tubular shape. The mouthpiece may have a rigidity that allows to compress the compression spring and to push the aerosol-generating article into the storage chamber.

In embodiments in which the mouthpiece is not used for compressing the compression spring of the spring loaded mechanism, the mouthpiece may also be made from a soft or elastic plastic material having a small rigidity. An elastic plastic material may be convenient to handle. In addition an elastic material may ensure a good sealing to the proximal end of the aerosol-generating article.

The spring loaded mechanism may include a retention element that may maintain the mouthpiece in the first, retracted position in the housing, if the lid is open or if the lid is closed and no aerosol-generating article is inserted into the heating chamber of the aerosol-generating device. The spring loaded mechanism may include a spring loaded pushing element that is retained in a retracted position by the retention element, if the lid portion is open or if the lid portion is closed and no aerosol-generating article is inserted into the heating chamber of the aerosol-generating device. Together with the retracted pushing element also the mouthpiece is maintained in the first, retracted position.

The retention element may retain an expansion spring in a compressed configuration in which the mouthpiece is maintained in the retracted position.

The spring loaded mechanism may include a lever mechanism that is configured to move the retention element and to thereby unlock the pushing element, if an aerosol-generating article is inserted into the heating chamber and the lid portion is closed. The lever mechanism may comprise a pivotingly mounted lever. The lower end of lever may contact the outer circumferential surface of an aerosol-generating article located in the heating chamber upon closure of the lid portion. The lower end of the lever may contact the aerosol-generating article and may thereby be pivoted around its rotation axis. Thereby the lever may move the retention element to unlock the pushing element. Pushing element may then be pushed outward by an expansion spring. Outward movement of the pushing element may be limited by a blocking arm. When the pushing element contacts the blocking arm, the mouthpiece may be positioned in the second, protruding position.

Both of the above described spring loaded mechanism allow that the mouthpiece is automatically retracted into the housing, if the aerosol-generating device is open or if no aerosol-generating article is inserted. In other words, if the aerosol-generating device is not about to be used, the mouthpiece is safely withdrawn into the housing. On the other hand, if the device is brought in a ready to use operation and an aerosol-generating article is inserted, the mouthpiece is automatically protruded from the housing, such that the mouthpiece may conveniently be placed in a user's mouth. No additional manual manipulation of the aerosol-generating device is required in this regard. The overall handling of the aerosol-generating device is thereby increased in both embodiments.

In embodiments the movement of the hingedly connected lid may be utilized to assist in transferring a consumed aerosol-generating article into the storage chamber of the aerosol-generating.

For this purpose, the hingedly connected lid may be connected to a driving mechanism. The driving mechanism may be used to open the bottom surface of the heating chamber. The driving mechanism may be configured to engage the moveable element and to move the moveable element into the open position in which a passage from the heating chamber into the storage chamber is opened.

The driving mechanism may be further configured to be connected to the transfer mechanism. The driving mechanism may be configured to drive the at least one rotating wheel of the transfer mechanism. In this way the movement of the hinged lid is used to provide the required motoric force to urge the used consumable into the storage chamber.

Opening of the bottom surface of the heating chamber and driving the transfer mechanism to move the used consumable into the storage chamber can be done simultaneously in a single opening movement of the hinged lid.

Alternatively these movements can be decoupled from each other and can be performed in consecutive steps. For example, in a first opening movement, the bottom surface of the heating chamber can be opened. Upon a consecutive closing of the lid, a second movement step may be performed in which the driving mechanism of the lid is connected to and engaging with the driving mechanism to transfer the used consumable into the storage chamber. Such embodiments offer again the advantage that during the transfer the aerosol-generating article does not need to be touched by the user's hand. Moreover, in such embodiment no additional moveable elements are required, since all required movements can be caused by the opening and closing movement of the hinged lid.

The storage chamber may be configured to hold a single aerosol-generating article. This allows to reduce the space requirements for the aerosol-generating device.

The storage chamber may also be configured to hold a plurality of aerosol-generating articles. For example the storage chamber may comprise a storage element that is configured for holding a plurality of aerosol-generating articles. The storage element may comprise a plurality of retainers each configured to take up a single aerosol-generating article. The storage element may have rotary symmetric construction. The retainers may be evenly distributed at eth storage element. The storage element may be rotatably mounted in the storage chamber. Before a consumed aerosol-generating article is transferred into the storage chamber, the storage element may be rotated such that a free retainer is placed under the opening to the heating chamber. Once all retainers are occupied by consumed aerosol-generating articles, the storage chamber has to be opened and the consumed aerosol-generating articles have to be removed from the aerosol-generating device.

The storage element may also be configured to hold fresh and unused aerosol-generating articles. The aerosol-generating device may be configured to allow transfer of fresh aerosol-generating articles from the storage chamber into the heating chamber. With such functionality the storage chamber may not only be used to hold consumed articles, but may also be used to hold one or more fresh aerosol-generating articles. Thereby the use period of the aerosol generating device may be extended.

In order to transfer fresh aerosol-generating articles from the storage chamber into the heating chamber, the retainers of the storage element may comprise a spring loaded mechanism. The retainers may be locked during storage in a retracted storage position. Upon transfer into the heating chamber the storage element is first rotated into a position in which a retainer holding a fresh aerosol-generating article is positioned below the heating chamber. This retainer may then be unlocked such that the fresh aerosol-generating article is pushed upward towards the heating chamber. The fresh aerosol-generating article is pushed upwards at least so far such that it is engaged by the at least one rotating wheel of the transfer mechanism. The transfer mechanism then transfers the fresh aerosol-generating article into the heating chamber. For this loading movement the transfer mechanism is operated essentially opposite to the previously described movement of consumed aerosol-generating articles into the storage chamber.

Rotation of the storage element may be obtained by a mechanism that can be driven by the user manually. Alternatively this rotation movement may be driven by an electric motor. Further alternatively, rotational movement may be obtained by coupling the storage element to the driving mechanism driven by the movement of the hinged lid.

A full replacement operation including transferring a used aerosol-generating article into the storage chamber and replacing it by fresh aerosol-generating article may be achieved by sequentially opening and closing the hinged lid. For this purpose the driving mechanism may be configured to be consecutively coupled to the various moveable elements that are used to perform the aerosol-generating article replacement procedure.

Below, there is provided a non-exhaustive list of non-limiting examples. Any one or more of the features of these examples may be combined with any one or more features of another example, embodiment, or aspect described herein.

Example A: Aerosol-generating device comprising

- a housing having a main portion and a lid portion, wherein the lid portion is hingedly connected to the main portion,
- a mouthpiece provided at the lid portion, the mouthpiece being configured to be moveable between a first position, in which the mouthpiece is retracted into the housing, and a second position, in which the mouthpiece protrudes from the lid portion, and
- a spring loaded mechanism, wherein the spring loaded mechanism is configured to move the mouthpiece from the one position into the other position.

Example B: Aerosol-generating device according to example 1, wherein the main portion comprises a power source, control electronics and a heating chamber.

Example C: Aerosol-generating device according to any preceding example, wherein the spring loaded mechanism is configured to perform movement of the mouthpiece upon opening or closure of the lid portion.

Example D: Aerosol-generating device according to any preceding example, wherein the spring loaded mechanism is configured to perform movement of the mouthpiece in dependence of the presence or the absence of an aerosol-generating article in the heating chamber of the aerosol-generating device.

Example E: Aerosol-generating device according to any preceding example, wherein the spring loaded mechanism is configured to move the mouthpiece in the first position when no aerosol-generating article is in the heating chamber of the aerosol-generating device.

Example F: Aerosol-generating device according to any preceding example, wherein the spring loaded mechanism is configured to move the mouthpiece into the second position when an aerosol-generating article is in the heating chamber of the aerosol-generating device.

Example G: Aerosol-generating device according to any preceding example, wherein the mouthpiece in the second position is sealingly engaged with the aerosol-generating article to establish a defined air flow path from the aerosol-generating article through the mouthpiece.

Example H: Aerosol-generating device according any preceding example, wherein the heating chamber in the main portion is elongate and has a cross-section that corresponds to the cross-section of the aerosol-generating article that is to be used with and inserted into the heating chamber of the aerosol-generating device.

Example I: Aerosol-generating device according to any preceding example, wherein the heating chamber comprises an external heater for heating the aerosol-generating article.

Example J: Aerosol-generating device according to any preceding example, wherein the heating chamber has a bottom surface that restricts movement of the aerosol-generating article into the heating chamber.

Example K: Aerosol-generating device according to any preceding example, wherein the main part comprises a storage chamber located below the bottom surface of the heating chamber.

Example L: Aerosol-generating device according to any preceding example, wherein the storage chamber is configured to store at least one used aerosol-generating article.

Example M: Aerosol-generating device according to any preceding example, comprising an opening mechanism for opening the bottom surface of the heating chamber.

Example N: Aerosol-generating device according to any preceding example, wherein the opening mechanism for opening the bottom surface comprises a button or a slider.

Example O: Aerosol-generating device according to any preceding example, comprising a transfer mechanism configured to transfer an aerosol-generating article from the heating chamber into the storage chamber.

Example P: Aerosol-generating device according to any preceding example, wherein the transfer mechanism comprises a rotating wheel that frictionally engages an outer surface of the aerosol-generating article to transfer the aerosol-generating article from the heating chamber into the storage chamber.

Example Q: Aerosol-generating device according to any preceding example, wherein the rotating wheel is manually operated or is driven by an electrical motor.

Example R: Aerosol-generating device according to any preceding example, wherein the mouthpiece is made from rigid material and the transfer mechanism is triggered by the user pressing the mouthpiece towards the housing.

Example S: Aerosol-generating device according to any preceding example, wherein the mouthpiece is made from rigid material and the spring loaded mechanism comprises a compression spring that is configured to maintain the mouthpiece in the first position when no aerosol-generating article is in the heating chamber of the aerosol-generating device, and wherein the compression spring is compressed and the mouthpiece is extended out of the housing upon closure of the lid, when an aerosol-generating article is inserted the heating chamber of the aerosol-generating device.

Example T: Aerosol-generating device according to any preceding example, wherein the spring constant of the compression spring is smaller than the resistance to compression of the aerosol-generating article.

Example U: Aerosol-generating device according to any preceding example, wherein the spring constant is below 10 N/m.

Example V: Aerosol-generating device according to any preceding example, wherein the mouthpiece is made from a soft plastic material. (which is pleasant to handle and ensures a good sealing to consumable)

Example W: Aerosol-generating device according to any preceding example, wherein the movement mechanism includes a spring loaded pushing element that is locked and that retains the mouthpiece in the lid portion if no aerosol-generating article is inserted into the aerosol-generating device.

Example X: Aerosol-generating device according to any preceding example, wherein the movement mechanism includes a lever mechanism that unlocks the retention element such that spring loaded pushing element is unlocked and pushes the mouthpiece to protrude out of the lid portion, if an aerosol-generating article is inserted into the aerosol-generating device.

Example Y: Aerosol-generating device according to any preceding example, wherein the movement mechanism includes a lever mechanism that comprises a lever contacting the outer surface of the aerosol-generating article, and is thereby pivoted to move the retention element to an unlock position.

Example Z: Aerosol-generating device according to any preceding example, wherein the lid portion connects to a driving mechanism including a transfer wheel which is configured to force the aerosol-generating article into the storage chamber.

Example ZA: Aerosol-generating device according to any preceding example, wherein the storage chamber is configured to hold a plurality of aerosol-generating articles.

Example ZB: Aerosol-generating device according to any preceding example, wherein the storage chamber comprises a storage element for holding a plurality of aerosol-generating articles.

Example ZC: Aerosol-generating device according to any preceding example, wherein the storage element is rotatable and comprises a plurality of retainers, each container being configured to take up a single aerosol-generating article.

Example ZD: Aerosol-generating device according to any preceding example, wherein the retainers are evenly distributed over the circumference of the storage element.

Example ZE: Aerosol-generating device according to any preceding example, wherein the retainers are spring loaded, the retainers being locked during storage and are configured to be unlocked when an aerosol-generating article is to be transferred into the heating chamber of the aerosol-generating device.

Example ZF: Aerosol-generating device according to any preceding example, wherein the transfer mechanism is configured to pull an aerosol-generating article upward into the heating chamber.

Example ZG: Aerosol-generating device according to any preceding example, wherein the transfer mechanism is driven by the opening and closing movement of the hinged lid portion.

Features described in relation to one embodiment may equally be applied to other embodiments of the invention.

FIG. 1 shows a prior art aerosol-generating system 10 comprising an aerosol-generating device 12 and an aerosol-generating article 14. The aerosol-generating device 12 comprises a main portion 16 and a removable lid portion 18. The lid portion 18 in turn comprises a replaceable mouthpiece 20. On the left in FIG. 1 an exploded view of the aerosol-generating system is depicted.

On the right in FIG. 1 a fully assembled aerosol-generating device 12 with an inserted aerosol-generating article 14 is shown. In use the aerosol-generating article 14 is completely received in a closed cavity within the aerosol-generating device 12. A user may inhale the aerosol via the replaceable mouthpiece 20.

Figure 2:
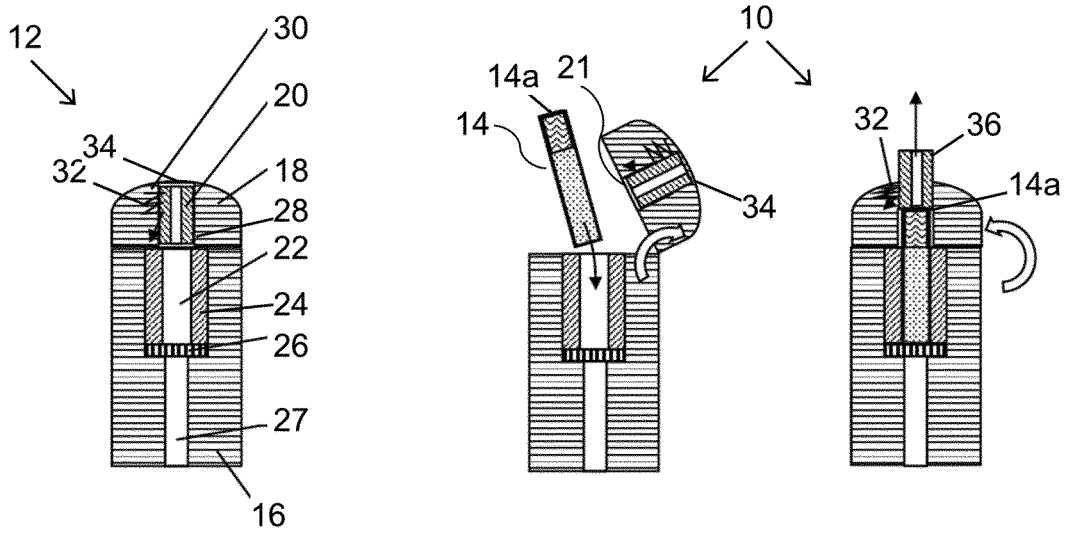
FIG. 2 shows an aerosol-generating device according to the present invention.

FIG. 2 shows an aerosol-generating device 12 according to the present invention. The aerosol-generating device 12 comprises a main portion 16 and a lid portion 18. The lid portion 18 and the main portion 16 form the housing of the aerosol-generating device 12. The lid portion 18 is hingedly connected to the main portion 16. In the main portion 16

The aerosol-generating device 12 comprises a power source (not shown) and electric circuitry (not shown) including a controller for controlling operation of the aerosol-generating device 12. The aerosol-generating device 12 further comprises a heating chamber 22 with a resistive heating element 24. The bottom surface of the heating chamber 22 is formed from a perforated element 26. The perforated element 26 limits the downward movement of the aerosol-generating article 14 in the heating chamber 22. The perforated element also allows to introduce ambient air from an air flow path 27 into the heating chamber.

A mouthpiece 20 is provided at the lid portion 18. The mouthpiece is a rigid polymeric tube that is linearly moveable within a channel 28 formed in the lid portion 18. The lid portion 18 comprises a spring loaded mechanism 30. The spring loaded mechanism 30 comprises a compression spring 32 which biases and maintains the mouthpiece 20 in a first position 34. In the first position 34 the mouthpiece is fully retracted into the lid portion 18. When the lid portion 18 is closed and no aerosol-generating article 14 is inserted into the heating chamber 22, or when the lid portion 18 is open, the compression spring 32 maintains the mouthpiece 20 in the first position 34. These situations are depicted in the left view and in the middle view of FIG. 2.

When an aerosol-generating article 14 is inserted into the heating chamber 22 of the aerosol-generating device 12, the aerosol-generating article 14 engages with the mouthpiece 20 upon closure of the lid 18. As depicted in the right view of FIG. 2, the proximal end 14*a* of the aerosol-generating article 14 contacts the distal end 21 of the mouthpiece 20. The spring constant of the compression spring 32 is smaller than the compressive resistance of the aerosol-generating article 14. Thus, upon closure of the lid portion, as depicted in the right view of FIG. 2, the aerosol-generating article 14 compresses the compression spring 32 and pushes the mouthpiece 20 out of the lid portion 18. When the lid portion 18 is fully closed, the mouthpiece 20 is moved into a second position 36, in which the mouthpiece 20 protrudes from the lid portion 18. In this configuration the mouthpiece 20 can be placed into the mouth of a user.

Upon activation of the heater element 24 the aerosol-forming substrate of the aerosol-generating article 14 is heated. Ambient air is guided into the heating chamber 22 via air flow path 27 formed in the aerosol-generating device 12. The ambient air is mixed with the vapor generated in the heating chamber 22 and forms an aerosol that is inhaled by a user through the mouthpiece 20.

Figure 3:
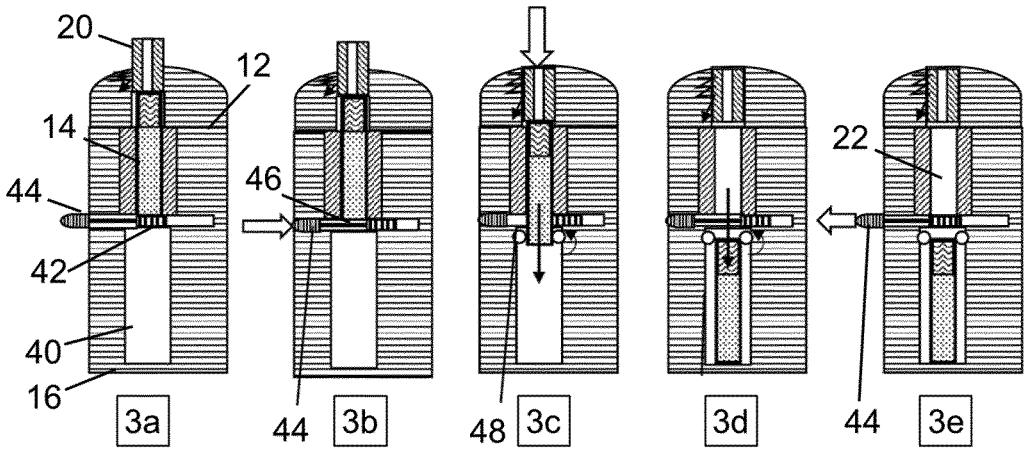
FIG. 3 illustrates a transfer mechanism of an aerosol-generating device.

FIG. 3 shows a further feature of the above described embodiment and illustrates a transfer mechanism for transferring a consumed aerosol-generating article 14 from the heating chamber 22 into a storage chamber 40.

As depicted in FIG. 3*a*, the aerosol-generating device 12 additional comprises a storage chamber 40 that is provided in the main portion 16 of the aerosol-generating device 12. In the depicted configuration the storage chamber 40 is provided below the heating chamber 22 and is separated from the heating chamber 22 by a moveable element 42. The moveable element 42 forms the bottom surface of the heating chamber 22 and is used to restrict the movement of the aerosol-generating article 14 into the heating chamber 22. The moveable element 42 is biased into a normally closed position by a further spring mechanism that is not described in detail herein.

By pressing button 44 the moveable element 42 can be moved into an open position in which a passageway 46 is opened between the heating chamber 22 and the storage chamber 40 as depicted in FIG. 3*b*.

In order to trigger the transfer mechanism, the user may then push the mouthpiece 20 into the first position 34 into the lid portion 18. This is indicated by the upper arrow in FIG. 3*c*. Thereby the mouthpiece 20 pushes the aerosol-generating article 14 through the passageway 46 towards the storage chamber 40, as indicated by the lower arrow in FIG. 3*c*. When the mouthpiece 20 is fully pushed back into the lid portion 18, a portion at the distal end of the aerosol-generating article 14 is clamped between two oppositely arranged rotating wheels 48. The oppositely arranged rotating wheels 48 frictionally engage the outer surface of the aerosol-generating article 14.

By rotating the oppositely arranged rotating wheels 48 the aerosol-generating article 14 is moved further downward from the heating chamber 22 into the storage chamber 40, as depicted in FIG. 3*d*. The oppositely arranged rotating wheels 48 are driven by corresponding driving means (not shown).

When the aerosol-generating article 14 is fully transferred into the storage chamber 40, as depicted in FIG. 3*e*, button 44 may be released. Upon release of the button 44 the moveable element 42 is moved back into the normally closed position. The aerosol generating device 12 is now ready to receive a fresh aerosol-generating article 14. A fresh aerosol-generating article 14 may be inserted by the user by opening the hinged lid portion 18.

Figure 4:
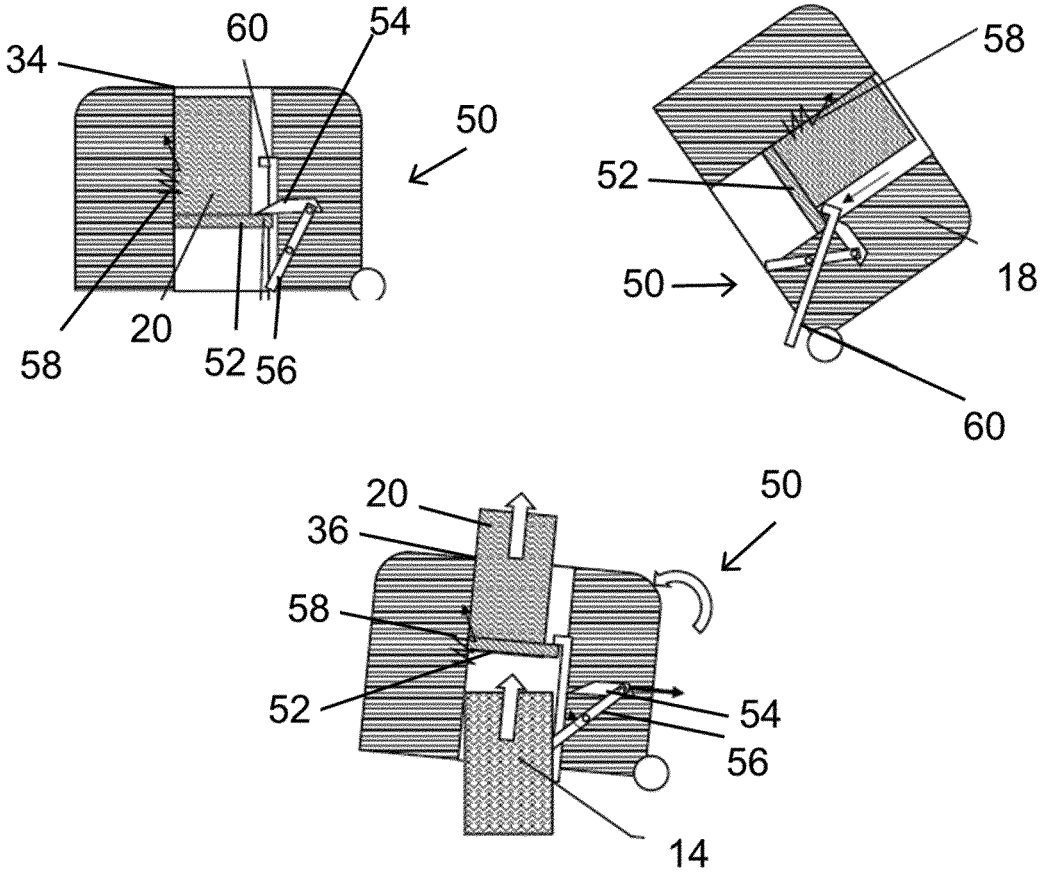
FIG. 4 shows a spring loaded mechanism for moving the mouthpiece.

FIG. 4 shows a further embodiment showing a different spring loaded mechanism 50 for moving the mouthpiece 20 from the first retracted position 34 into the second protruding position 36. The spring loaded mechanism 50 includes a spring loaded pushing element 52 that is retained in a retracted position by retention element 54, if the lid portion 18 is open or if the lid portion 18 is closed and no aerosol-generating article 14 is inserted into the heating chamber 22 of the aerosol-generating device 14. In this configuration the mouthpiece 20 is maintained in the first, retracted position 34. These situations are depicted in the two upper views of FIG. 4.

The spring loaded mechanism 50 includes a lever mechanism that moves the retention element 54 and unlocks the pushing element 52, if an aerosol-generating article 14 is inserted into the heating chamber 22 and the lid portion 18 is closed. This is depicted in the lower view of FIG. 4. The lever mechanism comprises a lever 56. The lower end of lever 56 contacts the outer circumferential surface of an aerosol-generating article 14 located in the heating chamber 22 when the lid portion 18 is closed. Upon closure of the lid portion 18, the lower end of lever 56 contacts the aerosol-generating article 14 and is thereby pivoted around its rotation axis. Thereby the lever 56 moves the retention element 54 to unlock the pushing element 52. Pushing element 52 is pushed outward by expansion spring 58. Outward movement of the pushing element 52 is limited by blocking arm 60. When the pushing element contacts blocking arm 60, the mouthpiece 20 is positioned in the second position 36, in which the mouthpiece 20 protrudes out of the lid portion 18 and can be put into the user's mouth.

Figure 5:
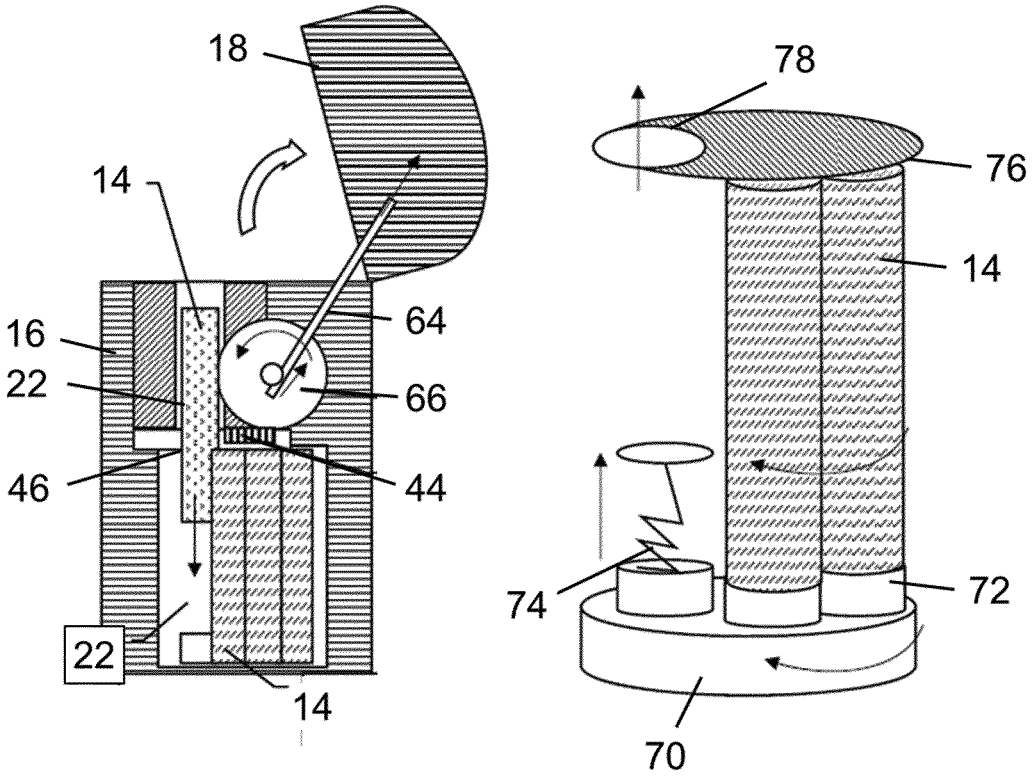
FIG. 5 shows details of a storage chamber of an aerosol-generating device.

FIG. 5 shows a further modification of the aerosol-generating device 12 in which the rotational movement of the hingedly connected lid portion 18 is utilized to assist in transferring a consumed aerosol-generating article 14 into the storage chamber 40 of the aerosol-generating device 12.

The hingedly connected lid portion 18 connects to a driving element 64 that engages with a rotatably mounted driving wheel 66. The driving wheel 66 engages with the moveable element 44 forming the bottom surface of the heating chamber 22. The driving wheel 66 is configured to move the moveable element 44 into an open position in which a passageway 46 is opened between the heating chamber 22 and the storage chamber 40.

The outer surface of the driving wheel 66 may also contact the outer circumference of the aerosol-generating article 14 located in the heating chamber 22. The rotating driving wheel 66 frictionally engages the aerosol-generating article 14 and urges the used aerosol-generating article 14 downward through the open passageway 46 into the storage chamber 40.

As depicted in FIG. 5 the storage chamber 40 is configured to hold a plurality of aerosol-generating articles 14. The storage chamber 40 comprises a cylindrical storage element 70 with a plurality of evenly distributed retainers 72. Each retainer 72 is configured to hold an aerosol-generating article 14.

The cylindrical storage element 70 is configured to hold also a plurality of fresh aerosol-generating articles 14. The aerosol-generating device 12 is configured to allow transfer of fresh aerosol-generating articles 14 from the storage chamber 40 into the heating chamber 22.

In order to transfer a fresh aerosol-generating article 14 from the storage chamber 40 into the heating chamber 22, each retainer 72 of the storage element 40 comprises a spring mechanism 74. A circular retaining element 76 holds the retainers 72 carrying an aerosol-generating article 14 in a retracted storage position.

In order to transfer a fresh aerosol-generating article 14 into the heating chamber 22, the storage element 70 is first rotated into a position in which a retainer 72 holding a fresh aerosol-generating article 14 is positioned below the heating chamber 22. In this position the aerosol-generating article 14 is positioned below the opening 78 in the retaining element 76, such that the spring mechanism 74 pushes the fresh aerosol-generating article 14 upward towards the heating chamber 22.

The fresh aerosol-generating article 14 is pushed upwards so far such that the aerosol-generating article 14 is engaged by the driving wheel 66 of the transfer mechanism. The transfer mechanism then transfers the fresh aerosol-generating article 14 into the heating chamber 22.

The invention claimed is:

1. An aerosol-generating device, comprising:

a housing having a main portion and a lid portion, wherein the lid portion is hingedly connected to the main portion;

a mouthpiece disposed on the lid portion, the mouthpiece being configured to be moveable between a first position, in which the mouthpiece is retracted into the housing, and a second position, in which the mouthpiece protrudes from the lid portion; and a spring-loaded mechanism configured to move the mouthpiece from the first position into the second position, wherein the spring-loaded mechanism includes a spring-loaded pushing element that is locked and that retains the mouthpiece in the lid portion if no aerosol-generating article is inserted into the aerosol-generating device.

2. The aerosol-generating device according to claim 1, wherein the spring-loaded mechanism is further configured to perform movement of the mouthpiece upon opening or closure of the lid portion.

3. The aerosol-generating device according to claim 1, wherein the spring-loaded mechanism is further configured to perform movement of the mouthpiece in dependence of a presence or an absence of an aerosol-generating article in a heating chamber of the aerosol-generating device.

4. The aerosol-generating device according to claim 1, wherein the spring-loaded mechanism is further configured to move the mouthpiece into the second position when an aerosol-generating article is in a heating chamber of the aerosol-generating device.

5. The aerosol-generating device according to claim 1, wherein the main portion comprises a heating chamber, and wherein the heating chamber has a bottom surface that restricts movement of an aerosol-generating article into the heating chamber.

6. The aerosol-generating device according to claim 5, wherein the main portion further comprises a storage chamber disposed below the bottom surface of the heating chamber.

7. The aerosol-generating device according to claim 5, further comprising an opening mechanism configured to open the bottom surface of the heating chamber.

8. The aerosol-generating device according to claim 7, further comprising a transfer mechanism configured to transfer the aerosol-generating article from the heating chamber into a storage chamber disposed below the bottom surface of the heating chamber.

9. The aerosol-generating device according to claim 8, wherein the mouthpiece is made from rigid material and the transfer mechanism is triggered by a user pressing the mouthpiece towards the housing.

10. The aerosol-generating device according to claim 1, further comprising a heating chamber configured to receive an aerosol-generating article, wherein the mouthpiece is made from rigid material and the spring-loaded mechanism comprises a compression spring that is configured to maintain the mouthpiece in the first position when no aerosol-generating article is in the heating chamber of the aerosol-generating device, and wherein the compression spring is compressed and the mouthpiece is extended out of the housing upon closure of the lid, when an aerosol-generating article is inserted in the heating chamber of the aerosol-generating device.

11. The aerosol-generating device according to claim 1, wherein the spring-loaded mechanism further includes a lever mechanism that unlocks a retention element such that the spring-loaded pushing element is unlocked and pushes the mouthpiece to protrude out of the lid portion, if an aerosol-generating article is inserted into the aerosol-generating device.

12. The aerosol-generating device according to claim 6, wherein the lid portion connects to a driving mechanism including a transfer wheel that is configured to force the aerosol-generating article into the storage chamber.

13. The aerosol-generating device according to claim 6, wherein the storage chamber comprises a storage element configured to hold a plurality of aerosol-generating articles.

14. The aerosol-generating device according to claim 8, wherein the transfer mechanism is driven by the opening and closing movement of the lid portion.

* * * * *